US009315756B2

(12) United States Patent
Patil et al.

(10) Patent No.: US 9,315,756 B2
(45) Date of Patent: Apr. 19, 2016

(54) BIO-FEEDS BASED HYBRID GROUP V BASE STOCKS AND METHOD OF PRODUCTION THEREOF

(71) Applicant: ExxonMobil Research and Engineering Company, Annandale, NJ (US)

(72) Inventors: Abhimanyu O. Patil, Westfield, NJ (US); Satish Bodige, Wayne, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 365 days.

(21) Appl. No.: 13/856,618

(22) Filed: Apr. 4, 2013

(65) Prior Publication Data

US 2013/0267450 A1 Oct. 10, 2013

Related U.S. Application Data

(60) Provisional application No. 61/621,167, filed on Apr. 6, 2012.

(51) Int. Cl.
*C10M 105/34* (2006.01)
*C10M 109/02* (2006.01)

(52) U.S. Cl.
CPC ..... *C10M 105/34* (2013.01); *C10M 109/02* (2013.01); *C10M 2207/2815* (2013.01); *C10N 2230/02* (2013.01); *C10N 2230/54* (2013.01); *C10N 2230/70* (2013.01); *C10N 2240/10* (2013.01)

(58) Field of Classification Search
CPC ..... C07C 69/612
USPC ..... 508/478–483, 491; 554/124, 162
See application file for complete search history.

(56) References Cited

U.S. PATENT DOCUMENTS

| | | | |
|---|---|---|---|
| 2,043,836 | A | 6/1936 | Moran |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,254,025 | A | 5/1966 | LeSuer |
| 3,275,554 | A | 9/1966 | Wagenaar |
| 3,316,177 | A | 4/1967 | Dorer, Jr. |
| 3,325,408 | A | 6/1967 | Wayo |
| 3,329,658 | A | 7/1967 | Fields |
| 3,341,542 | A | 9/1967 | LeSuer et al. |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer et al. |
| 3,519,565 | A | 7/1970 | Coleman |
| 3,541,012 | A | 11/1970 | Stuebe |
| 3,565,804 | A | 2/1971 | Powers |
| 3,595,889 | A | 7/1971 | Wayo |
| 3,630,904 | A | 12/1971 | Musser et al. |
| 3,632,511 | A | 1/1972 | Liao |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,725,277 | A | 4/1973 | Worrel |
| 3,725,480 | A | 4/1973 | Traise et al. |
| 3,726,882 | A | 4/1973 | Traise et al. |
| 3,787,374 | A | 1/1974 | Adams |
| 4,100,082 | A | 7/1978 | Clason et al. |
| 4,303,590 | A | 12/1981 | Tanaka et al. |
| 4,454,059 | A | 6/1984 | Pindar et al. |
| 4,889,647 | A | 12/1989 | Rowan et al. |
| 4,978,464 | A | 12/1990 | Coyle et al. |
| 5,034,563 | A | 7/1991 | Ashijian et al. |
| 5,171,195 | A | 12/1992 | Funamoto |
| 5,344,578 | A | 9/1994 | Wei et al. |

(Continued)

FOREIGN PATENT DOCUMENTS

| | | | |
|---|---|---|---|
| EP | 471071 | B1 | 8/1995 |
| WO | 9931113 | A1 | 6/1999 |

OTHER PUBLICATIONS

Cagniant, P.; Deluzarche, A.; Colomb, M. "The Synthesis of Lubricating Oils by Alkylation of Condensed Ring Systems", Annales des Mines de Belgique (1945), 134, 456-72 CODEN: ANMBAK; ISSN: 0003-4290.

Jorand, J., "Derivatives of Naphthalenes and Fatty Acids: Heptanoylnaphthalenes and -naphthols", Oleagineux (1960), 15, 183-8 CODEN: OLEAAF; ISSN: 0030-2082.

*Primary Examiner* — Ellen McAvoy

(74) *Attorney, Agent, or Firm* — Robert A. Migliorini

(57) ABSTRACT

A composition that includes one or more compounds represented by the formula $$A(B)_x$$

wherein A is the residue of an aromatic compound, B is the residue of an unsaturated hydrocarbon ester, and x is a value of 1 or greater. The composition has a viscosity ($Kv_{100}$) from 2 to 40 at 100° C., and a viscosity index (VI) from 100 to 200. The disclosure also relates to a process for producing the composition, a lubricating oil base stock and lubricating oil containing the composition, and a method for improving one or more of solubility and dispersancy of polar additives in a lubricating oil by using as the lubricating oil a formulated oil containing the composition. The lubricating oils containing the composition are advantageous as engine oils that can improve engine fuel efficiency.

5 Claims, No Drawings

(56) References Cited

U.S. PATENT DOCUMENTS

| | | | | |
|---|---|---|---|---|
| 5,354,878 | A | 10/1994 | Connemann et al. | |
| 5,371,248 | A | 12/1994 | Rudnick | |
| 5,395,538 | A | 3/1995 | Rudnick et al. | |
| 5,516,954 | A | 5/1996 | Chang et al. | |
| 5,525,126 | A | 6/1996 | Basu et al. | |
| 5,552,071 | A | 9/1996 | Rudnick et al. | |
| 5,705,458 | A | 1/1998 | Roby et al. | |
| 5,840,942 | A * | 11/1998 | Oude Alink | C07C 51/347 554/161 |
| 6,071,864 | A | 6/2000 | Hsi Ho et al. | |
| 6,271,185 | B1 * | 8/2001 | Kodali et al. | 508/487 |
| 6,436,882 | B1 | 8/2002 | Rizvi | |
| 6,491,809 | B1 | 12/2002 | Briot et al. | |
| 7,601,677 | B2 * | 10/2009 | Graiver et al. | 508/491 |
| 8,080,679 | B2 * | 12/2011 | Hatcher et al. | 554/167 |
| 8,173,825 | B2 * | 5/2012 | Erhan et al. | 554/149 |
| 8,389,753 | B2 * | 3/2013 | Higgins et al. | 554/124 |
| 8,450,370 | B2 * | 5/2013 | Hatcher et al. | 514/560 |
| 8,586,805 | B2 * | 11/2013 | Miller | C10G 3/46 44/308 |
| 9,169,202 | B2 * | 10/2015 | Smith | C08K 5/10 |
| 2002/0010359 | A1 | 1/2002 | Kaita et al. | |
| 2003/0149289 | A1 | 8/2003 | Suppes | |
| 2008/0300157 | A1 | 12/2008 | Wu et al. | |
| 2009/0156844 | A1 * | 6/2009 | Banavali et al. | 554/124 |
| 2013/0172589 | A1 * | 7/2013 | Smith et al. | 554/95 |
| 2014/0284520 | A1 * | 9/2014 | Hategan et al. | 252/182.12 |

* cited by examiner

BIO-FEEDS BASED HYBRID GROUP V BASE STOCKS AND METHOD OF PRODUCTION THEREOF

CROSS-REFERENCE TO RELATED APPLICATIONS

This application claims the benefit of U.S. Provisional Application Ser. No. 61/621,167, filed on Apr. 6, 2012; which is incorporated herein in its entirety by reference

FIELD

This disclosure relates to at least one renewable feedstream based hybrid compositions, a process for producing the compositions, a lubricating oil base stock and lubricating oil containing the composition, and a method for improving one or more of solubility and dispersancy of polar additives in a lubricating oil by using as the lubricating oil a formulated oil containing the composition.

BACKGROUND

Polyalphaolefins (PAOs), Gas-to-Liquid (GTL), Visom, and the like, are important class of lube base stocks with many excellent lubricating properties, including high viscosity index (VI) but have low polarity. This low polarity leads to low solubility and dispersancy for polar additives or sludge generated during service. To compensate for this low polarity, lubricant formulators usually add one or multiple polar co-base stocks such as esters or alkylated naphthalenes. Such polar co-base stocks are often used in PAO formulations at 1 wt %-50 wt % levels to increase the fluid polarity.

Esters and alkylated naphthalene base stocks have many advantages but also have some disadvantages. Alkylated naphthalene is a key component in passenger vehicle lubricants, commercial vehicle lubricants, and industrial products. Alkylated naphthalene is very stable molecule but is not very polar. Esters are polar but potentially hydrolytically unstable. Ideal esters would be those having an ester group at the end of the molecule rather than middle as found in commercial adipate type esters.

There is an interest and opportunities in developing Group V polar base stocks from potentially inexpensive and/or "renewable" feeds based raw materials. For environmental, economical, and regulatory reasons, it is of interest to produce fuels, chemicals, and lube oils from renewable sources of biological origin. Most common biological sources are natural oils, which can be derived from plant sources such as canola oil, castor oil, sunflower seed oil, rapeseed oil, peanut oil, soy bean oil, and tall oil, or derived from animal fats. The basic structural unit of natural oils and fats is a triglyceride, which is an ester of glycerol with three fatty acid molecules represented by the following structure:

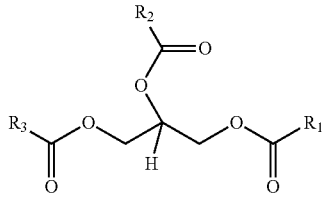

wherein $R_1$, $R_2$, and $R_3$ represent $C_4$-$C_{30}$ hydrocarbon chains.

In the hydrolysis of triglycerides, one obtains glycerol and fatty esters. With recent development in biodiesel production, unsaturated fatty acids and their esters are increasingly available. Use of these molecules as feedstocks would be desirable. Biodiesel (methyl oleate) is produced via the transesterification of seed oils. However, biodiesel has a problem associated with oxidation due to unsaturated double bond in the fatty esters.

Therefore, it would be desirable to take advantage of the renewable feedstocks, thus saving non-renewable petroleum raw materials. Furthermore, there is a need for a process for producing saturated hydrocarbon ester starting materials of biological origin, and to avoid the problem associated with oxidation due to unsaturated double bonds in the fatty esters. There is also a need for Group V base fluids that are high performance base stocks and that differentiate from existing base stocks, e.g., fuel-economy enabling base stocks having low viscosity $Kv_{100}$ and high viscosity index (VI). There is a further need for polar fluids that provide appropriate solubility and dispersibility for polar additives or sludge generated during service of lubricating oils.

The present disclosure also provides many additional advantages, which shall become apparent as described below.

SUMMARY

This disclosure relates in part to a process for producing a composition comprising one or more saturated hydrocarbon esters. The process comprises reacting an unsaturated hydrocarbon ester with an aromatic compound in the presence of a catalyst and under conditions sufficient to produce the saturated hydrocarbon ester. The aromatic compound reacted saturated hydrocarbon ester can be used as a Group V base oil stock.

This disclosure also relates in part to a composition comprising one or more compounds represented by the formula $$A(B)_x$$

wherein A is the residue of an aromatic compound, B is the residue of an unsaturated hydrocarbon ester, and x is a value of 1 or greater. The composition has a viscosity ($Kv_{100}$) from 2 to 40 at 100° C., and a viscosity index (VI) from 100 to 200. The saturated hydrocarbon ester can be used as a Group V base oil stock.

This disclosure further relates in part to a composition comprising one or more fatty acid ester based hybrid compounds with built-in aromatic, e.g., naphthalene, and ester polar functionalities. The one or more fatty acid ester based hybrid compounds are produced by a process comprising reacting an unsaturated hydrocarbon ester with an aromatic compound in the presence of a catalyst and under conditions sufficient to produce the one or more fatty acid ester based hybrid compounds with built-in aromatic, e.g., naphthalene, and ester polar functionalities.

This disclosure yet further relates in part to a lubricating engine oil comprising a saturated hydrocarbon ester prepared by the above process.

This disclosure also relates in part to a lubricating engine oil comprising one or more compounds represented by the formula $$A(B)_x$$

wherein A is the residue of an aromatic compound, B is the residue of an unsaturated hydrocarbon ester, and x is a value of 1 or greater. The composition has a viscosity ($Kv_{100}$) from 2 to 40 at 100° C., and a viscosity index (VI) from 100 to 200. The lubricating engine oil can be used as a Group V base oil stock.

This disclosure yet further relates in part to a method for improving one or more of solubility and dispersancy of polar additives in a lubricating oil by using as the lubricating oil a formulated oil. The formulated oil comprises a lubricating oil base stock comprising one or more compounds represented by the formula $$A(B)_x$$

wherein A is the residue of an aromatic compound, B is the residue of an unsaturated hydrocarbon ester, and x is a value of 1 or greater. The formulated oil has a viscosity ($Kv_{100}$) from 2 to 40 at 100° C., and a viscosity index (VI) from 100 to 200. The lubricating engine oil can be used as a Group V base oil stock.

In accordance with this disclosure, fatty acid methyl ester (FAME) based hybrid Group V base stocks with built-in both aromatic, e.g., naphthalene, and ester polar functionalities are prepared via alkylation chemistry.

In addition to improved solubility and dispersibility for polar additives and/or sludge generated during service of lubricating oils, improved fuel efficiency can also be attained in an engine lubricated with a lubricating oil by using as the lubricating oil a formulated oil in accordance with this disclosure. The lubricating oils of this disclosure are particularly advantageous as passenger vehicle engine oil (PVEO) products.

Further objects, features and advantages of the present disclosure will be understood by reference to the following drawings and detailed description.

DETAILED DESCRIPTION

All numerical values within the detailed description and the claims herein are modified by "about" or "approximately" the indicated value, and take into account experimental error and variations that would be expected by a person having ordinary skill in the art.

This disclosure provides lubricating oils useful as engine oils and in other applications characterized by an excellent balance of low viscosity $Kv_{100}$ and high viscosity index (VI). The lubricating oil base stock can be any oil boiling in the lube oil boiling range, typically between 100 to 450° C. In the present specification and claims, the terms base oil(s) and base stock(s) are used interchangeably. The compositions of this disclosure have built-in polarity.

This disclosure relates to the synthesis of fatty acid methyl ester (FAME) based hybrid Group V base stocks or biodiesel (methyl oleate) based hybrid Group V base stocks with built-in both naphthalene and ester polar functionalities via alkylation chemistry. Alkylation chemistry converts oxidatively unstable diesel molecules into stable lube base stock via the reaction of methyl oleate double bond with naphthalene molecule. For example, as shown in the examples herein, methyl oleate was alkylated with naphthalene using acid catalyst. The resulting hybrid molecule exhibited desired lube properties ($Kv_{100}$ 7.6 cSt, VI 134 vs. AN12 VI 105 and AN5 VI 74). The alkylation reaction is illustrated below.

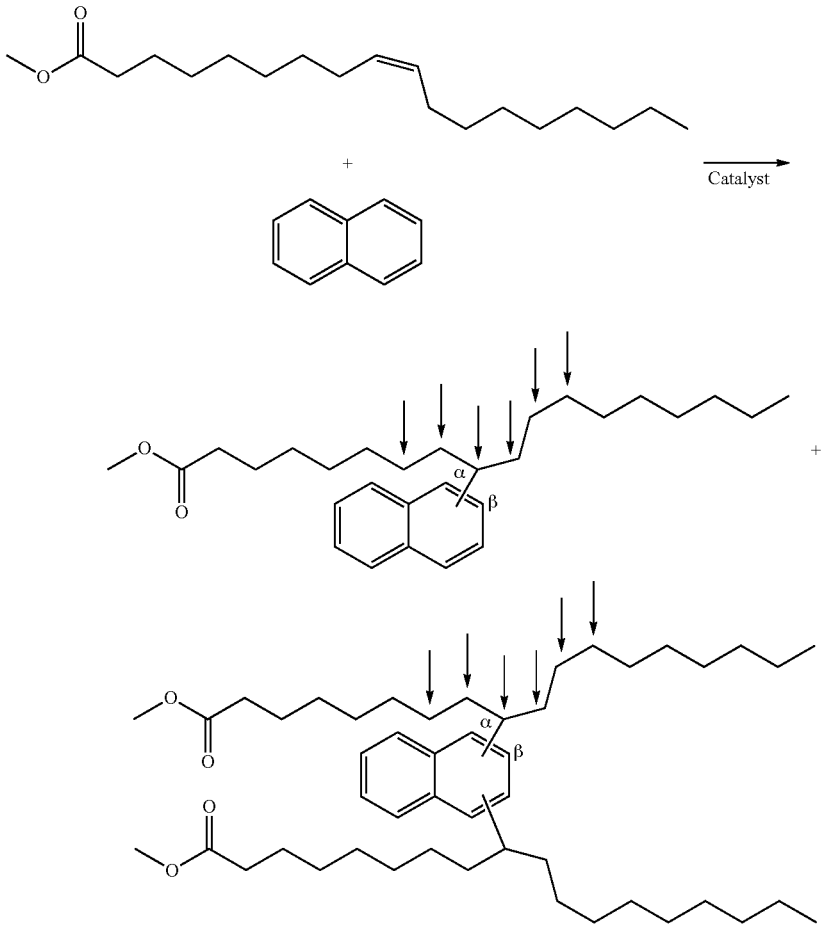

Performance tailoring can be achieved by using a variety of aromatic ring starting materials, reagent stoichiometry, and process conditions including synthesis of low viscosity low volatility (LVLV) molecules.

As indicated above, this disclosure relates to a process for producing a saturated hydrocarbon ester. The process comprises reacting an unsaturated hydrocarbon ester with an aromatic compound in the presence of a catalyst and under conditions sufficient to produce the saturated hydrocarbon ester. The aromatic compound reacted saturated hydrocarbon ester is preferably a Group V base oil stock.

Also, as indicated above, this disclosure relates to a composition comprising one or more compounds represented by the formula $$A(B)_x$$

wherein A is the residue of an aromatic compound, B is the residue of an unsaturated hydrocarbon ester, and x is a value of 1 or greater. The composition has a viscosity ($Kv_{100}$) from 2 to 40 at 100° C., and a viscosity index (VI) from 100 to 200. The saturated hydrocarbon ester is preferably a Group V base oil stock.

Lubricating Oil Base Stocks

A wide range of lubricating oils is known in the art. Lubricating oils that are useful in the present disclosure are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between 80 to 120 and contain greater than 0.03% sulfur and less than 90% saturates. Group II base stocks generally have a viscosity index of between 80 to 120, and contain less than or equal to 0.03% sulfur and greater than or equal to 90% saturates. Group III stock generally has a viscosity index greater than 120 and contains less than or equal to 0.03% sulfur and greater than 90% saturates. Group IV includes polyalphaolefins (PAO). Group V base stocks include base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

The bio-feeds based hybrid base stocks of this disclosure are included in Group V.

As indicated above, this disclosure relates to a lubricating engine oil comprising one or more compounds represented by the formula $$A(B)_x$$

wherein A is the residue of an aromatic compound, B is the residue of an unsaturated hydrocarbon ester, and x is a value of 1 or greater, preferably 2 or greater. The composition has a viscosity ($Kv_{100}$) from 2 to 40 at 100° C., and a viscosity index (VI) from 100 to 200. The lubricating engine oil can be used as a Group V base oil stock.

As indicated above, this disclosure relates to a lubricating oil comprising a lubricating oil base stock as a major component, and a fatty acid ester based hybrid cobase stock as a minor component. The fatty acid ester based hybrid cobase stock comprises one or more compounds represented by the formula $$A(B)_x$$

wherein A is the residue of an aromatic compound, B is the residue of an unsaturated hydrocarbon ester, and x is a value of 1 or greater. The composition has a viscosity ($Kv_{100}$) from 2 to 40 at 100° C., and a viscosity index (VI) from 100 to 200. The lubricating engine oil can be used as a Group V base oil stock.

The lubricating engine oil of this disclosure can have a viscosity $Kv_{100}$ of less than 100 cSt and a viscosity index (VI) greater than 70.

In accordance with this disclosure, there is provided process for making saturated hydrocarbon esters that can be used as lubricant base stocks. The process disclosed herein include: reacting unsaturated fatty ester from biological sources and aromatic ring like naphthalene to obtain lubricant base stock.

The unsaturated fatty ester reactant can be obtained from biological sources, e.g., renewable feedstreams. "Renewable feedstreams" as used herein, means starting materials that are derived from renewable sources. A source is considered renewable if it is replenished by nature at a faster rate than it is consumed. Renewable feedstreams useful herein include fatty acids, fatty acid esters, natural oils, biodiesel, triacylglycerides, or mixtures thereof.

"Natural oils" as used herein, include oils derived from biological sources, including animals, plants, algae, and fungi. Natural oils typically comprise mixtures of fatty acids and fatty acid esters, which are discussed below. These fatty acids often naturally occur as esters of three fatty acids and glycerol, known as triglycerides, also discussed below.

Natural oils useful herein preferably contain fatty acids and fatty acid esters with at least one site of unsaturation and include, but are not limited to, canola oil, corn oil, soybean oil, rapeseed oil, algae oil, peanut oil, mustard oil, sunflower oil, tung oil, tall oil, perilla oil, grapeseed oil, linseed oil, safflower oil, pumpkin oil, palm oil, *Jatropha* oil, high-oleic soybean oil, high-oleic safflower oil, high-oleic sunflower oil, mixtures of animal and vegetable fats and oils, beef tallow, castor bean oil, dehydrated castor bean oil, cucumber oil, poppyseed oil, flaxseed oil, lesquerella oil, walnut oil, cottonseed oil, meadowfoam, tuna oil, sesame oils, waste oils/greases, and mixtures thereof. Preferred renewable feedstream include palm oil, soybean oil, sunflower oil, canola oil, *Jatropha* oil, and algae oil.

While readily available vegetable oils are preferred sources of fatty acids for practicing disclosed embodiments of the present process, fatty acids and fatty acid esters available from animal fats including, without limitation, lard and fish oils, such as sardine oil, tuna oil, herring oil, and the like, may be employed in embodiments herein. Furthermore, particular fatty acids or fatty acid precursors may also be advantageously available from genetically modified organisms, such as genetically modified plants, particularly genetically modified algae. Such genetically modified organisms are typically designed to produce a desired fatty acid or fatty acid precursor biosynthetically or to advantageously produce increased amounts of such compounds. Preferred natural oils include palm oil, soybean oil, sunflower oil, canola oil, *Jatropha* oil, and algae oil.

Fatty acids are carboxylic acids with saturated or unsaturated aliphatic tails that occur naturally in many different natural oils. Fatty acid esters are alkyl esters of fatty acids, preferably $C_1$ to $C_{12}$ esters, preferably $C_1$ to $C_5$ esters, preferably methyl, ethyl, n-propyl, n-butyl esters, more preferably methyl or ethyl esters. An unsaturated fatty acid comprises a long carbon chain containing at least one carbon-carbon double bond and terminating in a carboxylic acid group. An unsaturated fatty acid ester also comprises a long carbon chain containing at least one carbon-carbon double bond but terminates in a carboxylate group.

Unsaturated fatty acids, unsaturated fatty acid esters, and mixtures thereof are of particular importance in embodiments herein. Any unsaturated fatty acid or fatty acid ester may be suitably employed to produce Group V base stock, provided that the unsaturated fatty acid or fatty acid ester can be alkylated in the manner disclosed herein. At least one carbon-carbon double bond may occur at any internal location, usually the middle of the aliphatic tail. A terminal carbon-carbon double bond, at the opposite end of the carbon chain relative to the carboxylic acid or carboxylate group, is also suitably employed, although terminal carbon-carbon double bonds occur less commonly in fatty acids.

Monounsaturated fatty acids and fatty acid esters contain one carbon-carbon double bond in the long aliphatic tail. Examples of monounsaturated fatty acids and fatty acid esters, useful herein, include myristoleic acid, palmitoleic acid, sapienic acid, oleic acid, erucic acid, and alkyl esters thereof. Polyunsaturated fatty acids and fatty acid esters contain two or more carbon-carbon double bonds in the long aliphatic tail. Examples of polyunsaturated fatty acids and esters, useful herein, include linoleic acid, linolenic acid, arachidonic acid, eicosapentaenoic acid, docosahexaenoic acid, and alkyl esters thereof. Some natural oils may contain fatty acids and fatty acid esters that are polyunsaturated, and some of the sites of unsaturation may be internal. Such polyunsaturated fatty acids and esters are particularly useful herein. For instance, oleic acid, linoleic acid, and linolenic acid, and their respective esters are examples of fatty acid and fatty acid esters with internal sites of unsaturation. Methyl oleate has one internal double bond, methyl linoleate has two internal double bonds, and methyl linolenoate has three internal double bonds, as shown below.

Fatty acids and fatty acid esters, useful herein, include monounsaturated fatty acids and esters thereof, polyunsaturated fatty acids and esters thereof, and mixtures of monounsaturated and polyunsaturated fatty acids and esters thereof.

Typically, the unsaturated fatty acid will contain greater than 8 carbon atoms, preferably, greater than 10 carbon atoms, and more preferably, greater than 12 carbon atoms. Typically, the unsaturated fatty acid will contain less than 50 carbon atoms, preferably, less than 35 carbon atoms, and less than 25 carbon atoms.

The unsaturated fatty acid may be straight or branched, and may be substituted along the fatty acid chain with one or more substituents, provided that the one or more substituents are substantially inert with respect to the alkylation process. Non-limiting examples of suitable substituents include alkyl moieties, preferably $C_{1-10}$ alkyl moieties, including, for example, methyl, ethyl, propyl, butyl, and the like; cycloalkyl moieties, preferably $C_{4-8}$ cycloalkyl moieties, including for example, cyclobutyl, cyclopentyl, cyclohexyl and cyclooctyl; monocyclic aromatic moieties, preferably $C_6$ aromatic moieties, including for example, phenyl; and alkylaryl moieties, preferably $C_{7-16}$ alkylaryl moieties, including, for example, tolyl, ethylphenyl, xylyl, and the like; as well as hydroxyl, ether, keto, aldehyde, and halide, preferably, chloride and bromide, functionalities.

Non-limiting examples of suitable unsaturated fatty acid and fatty acid esters include 3-hexenoic (hydrosorbic), trans-2-heptenoic, 2-octenoic, 2-nonenoic, cis- and trans-4-decenoic, 9-decenoic (caproleic), 10-undecenoic (undecylenic), trans-3-dodecenoic (linderic), tridecenoic, cis-9-tetradeceonic (myristoleic), pentadecenoic, cis-9-hexadecenoic (cis-9-palmitoelic), trans-9-hexadecenoic (trans-9-palmitoleic), 9-heptadecenoic, cis-6-octadecenoic (petroselinic), trans-6-octadecenoic (petroselaidic), cis-9-octadecenoic (oleic), trans-9-octadecenoic (elaidic), cis-11-octadecenoic, trans-11-octadecenoic (vaccenic), cis-5-eicosenoic, cis-9-eicosenoic (gadoleic), cis-1'-docosenoic (cetoleic), cis-13-docosenoic (erucic), trans-13-docosenoic (brassidic), cis-15-tetracosenoic (selacholeic), cis-17-hexacosenoic (ximenic), and cis-21-triacontenoic (lumequeic) acids, as well as 2,4-hexadienoic (sorbic), cis-9-cis-12-octadecadienoic (linoleic), cis-9-cis-12-cis-15-octadecatrienoic (linolenic), eleostearic, 12-hydroxy-cis-9-octadecenoic (ricinoleic), and like acids and corresponding esters thereof. Particularly, preferred fatty acids and fatty acid esters, useful herein, include oleic acid, linoleic acid, linolenic acid, and esters thereof.

The natural oils useful in the processes described herein typically include a mixture of saturated (Cn: 0), monounsaturated (Cn: 1), and polyunsaturated (Cn: 2, 3, etc.) fatty acids, where n is the number of carbon atoms present in the fatty acid. For example, the fatty acid profiles of several potential natural oil feedstreams are shown in Table 1 below.

TABLE 1

Fatty Acid Profile of Several Typical Natural Oils (wt %)

| Fatty Acid | Palm | Soybean | Sunflower | Canola | *Jatropha* |
|---|---|---|---|---|---|
| Myrisitic (C14:0) | 1.1 | 0.1 | 0 | 0 | 0 |
| Palmitic (C16:0) | 44 | 11 | 0 | 3.9 | 14.2 |
| Stearic (C18:0) | 4.5 | 4 | 4.5 | 1.9 | 7 |
| Oleic (C18:1) | 39.2 | 23.4 | 21.1 | 64.1 | 44.7 |
| Linoleic (C18:2) | 10.1 | 53.2 | 66.2 | 18.7 | 32.8 |
| Linolenic (C18:3) | 0.4 | 7.8 | 0 | 9.2 | 0.2 |
| Miscellaneous | 0.7 | 0.5 | 7.9 | 1.6 | 0.8 |

In a preferred embodiment, the renewable feedstream comprises a combination of natural oils. Preferred combinations include two or more of tall oil, palm oil, tallow, waste grease, rapeseed oil, canola oil, soybean oil, sunflower oil, *Jatropha* oil, and algae oil. Alternate useful combinations include two (three or four) or more of soybean oil, sunflower oil, palm oil, canola oil, rapeseed oil, algae oil, *Jatropha* oil, and tallow.

The chief constituent of natural oils is triacylglycerides (TAGs), also called triglycerides. TAGs are a naturally occurring ester of three fatty acids and glycerol. The three fatty acids can be all different, all the same, or only two the same. They can be saturated or unsaturated fatty acids, and the saturated fatty acids may have one or multiple sites of unsaturations. Chain lengths of the fatty acids in naturally occurring TAGs can be of varying lengths but 16, 18, and 20 carbons are the most common. Natural fatty acids found in plants and animals are typically composed of even numbers of carbon atoms due to the way they are bio-synthesized. Most natural fats contain a complex mixture of individual triglycerides and because of this, they melt over a broad range of temperatures.

TAGs typically have the chemical structure:

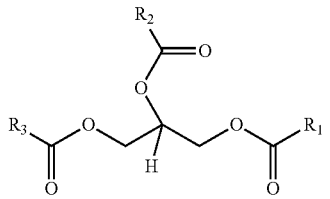

where $R_1$, $R_2$, and $R_3$ each, independently, represent a saturated or non-saturated hydrocarbon chain (preferably $R_1$, $R_2$, and $R_3$ each, independently, are a $C_{12}$ to $C_{28}$ alkyl or alkene, preferably $C_{16}$ to $C_{22}$ alkyl or alkene).

Different vegetable oils have different fatty acid profiles, with the same or different fatty acids occurring on a single glycerol. For example, an oil can have linoleic, oleic, and stearic acids attached to the same glycerol, with each of $R_1$, $R_2$, and $R_3$ each representing one of these three fatty acids. In another example, there can be two oleic acids and one stearic acid attached to the same glycerol, each of $R_1$, $R_2$, and $R_3$ each representing one of these fatty acids.

In one embodiment, a useful TAG consists of three unsaturated fatty acids, where at least one fatty acid is oleic acid. In another embodiment, a useful TAG consists of three unsaturated fatty acids, where at least one fatty acid is linoleic acid. In yet another embodiment, a useful TAG consists of three unsaturated fatty acids, where at least one fatty acid is oleic acid and at least one fatty acid is linoleic acid. In other embodiments, a mixture of different TAGs may be used.

Other materials containing fatty acid glycerides or other fatty acid esters can also be used, including phospholipids, lysophospholipids, and fatty acid wax esters. The free fatty acid content of useful natural oils is preferably 0.1 wt % or less when employed in a basic homogeneous catalyst esterification reaction. Higher levels can be utilized as well, and levels up to 3.0 wt %, or even as high as 15.0 wt % or more may be tolerated.

TAGs may be processed by transesterification with alcohols to give biodiesel. Biodiesel is typically a mixture of mono-alkyl fatty acid esters, and is useful as a renewable feedstream for methods disclosed herein. The processing of natural oils is discussed in greater detail below.

Raw or unrefined oils can be used in certain embodiments. However, filtered and refined oils are typically preferred. Use of degummed and filtered feedstreams minimizes the potential for emulsification and blockage in the reactor systems. Feedstreams with high water content can be dried before use. Feedstreams with high free fatty acid content can be passed through an esterification process to reduce the free fatty acid content before the process of esterification to convert fatty acid glycerides to monoalkyl esters. The reduction of free fatty acids and the conversion of fatty acid glycerides can be accomplished in the same processing step. Feedstreams containing other organic compounds (such as hexane, heptane, isohexane, etc.) can typically be processed without significant modifications to the reactor system.

In certain embodiments, processed oils, such as blown oils, are the source of fatty acids useful herein. Blown oils are processed through partial oxidation. Common blown oils available include linseed oil, castor oil, fish oil, and soybean oil.

Natural oils may be further processed before use in the present disclosure, for example, natural oils may be esterified with alcohols to convert any fatty acids present to fatty acid esters, to produce biodiesel. Biodiesel is a mixture of mono-alkyl fatty acid esters typically derived from the transesterification of natural oils and alcohols. While natural oils and alcohols are commonly employed as reactants in esterification reactions, any fatty acid source, such as free fatty acids, soaps, esters, glycerides (mono-, di-, and tri-), phospholipids, lysophospholipids, or amides and a monohydric alcohol source, such as an alcohol, can be esterified.

Biodiesel compositions that are particularly useful in this disclosure are those which have high concentrations of oleic acids, erucic acids, and esters thereof. These fatty acids and esters have one site of unsaturation such that cross-metathesis with ethylene yields the LAO, 1-decene, as the coproduct. Preferred biodiesel compositions are those produced from natural oils such as canola oil, rapeseed oil, palm oil, and other high oleic or high erucic oils. Particularly preferred natural oils include those having at least 30 mol % combined oleic and erucic fatty acid or esters of all fatty acid and fatty acid esters combined, preferably at least 40%, preferably at least 50%, preferably at least 60%, preferably at least 70%, preferably at least 80%, preferably at least 90%.

In other embodiments, biodiesel compositions that are particularly useful in this disclosure are those which have high concentrations of linoleic acid, linolenic acid, and esters thereof. These fatty acids and esters have multiple internal sites of unsaturation such that cross-metathesis with ethylene yields AIUNOs. Preferred biodiesel compositions are those produced from vegetable oils such as soybean oil, sunflower oil, *Jatropha* oil, and other high linoleic and linolenic oils. Particularly preferred vegetable oils include those having at least 30 mol % linoleic acid, linolenic acid, or esters thereof of all fatty acid and fatty acid esters combined, preferably at least 40%, preferably at least 50%, preferably at least 60%, preferably at least 70%, preferably at least 80%, preferably at least 90%.

In yet other embodiments, biodiesel compositions that are particularly useful in this disclosure are those which have high concentrations of oleic, erucic, linoleic, and linolenic acids and respective esters thereof. Preferred biodiesel compositions are those produced from vegetable oils such as canola oil, soybean oil, sunflower oil, *Jatropha* oil, and other oils having a high concentration of oleic, erucic, linoleic, and linolenic acids and respective esters thereof. Particularly preferred vegetable oils include those having at least 50 mol % oleic, erucic, linoleic, and linolenic acids and respective esters thereof of all fatty acid and fatty acid ester chains combined, preferably at least 60%, preferably at least 70%, preferably at least 80%, preferably at least 90%.

Advantageous starting natural oils for the process of this disclosure should contain a relatively high amount of components having a single double bond in the fatty acid or fatty ester (e.g., mono-unsaturated fatty acids or esters). Examples of the mono-unsaturated fatty acids include cis-5-dodecenoic acid, myristoleic acid (cis-9-tetardecenoic acid, C14:1), palmitoleic acid (cis-9-hexadecenoic acid, C16:1), olefic acid (cis-9-octadecenoic acid, C18:1), gadoleic acid (cis-11-eicosenoic acid C20:1), erucic acid (cis-13-docosenoic acid C22:1), elaidic acid [$CH_3(CH_2)_7CH{=}CH{-}(CH_2)_7COOH$], and vaccanic acid [$CH_3(CH_2)_5CH{=}CH{-}(CH_2)_9COOH$].

Although fatty acids can be used, more preferably mono-esters derived from triglycerides are used. Methods of making mono-esters are known. For example, see Process Economic Program Report 251 "Biodiesel Production" by Stanford Research Institute (SRI), or U.S. Pat. Nos. 4,303,590; 5,354,878; and 5,525,126 and U.S. Patent Application Publication Nos. 2002/0010359 and 2003/0149289. Further examples of such derivatives include methyl esters of these fatty acids, commonly known as fatty acid methyl ester (FAME) or biodiesel.

Unsaturated hydrocarbon esters should be used in an amount sufficient to react with the aromatic compound and form the saturated hydrocarbon esters of this disclosure.

Aromatic compounds useful in this disclosure include, for example, alkylated naphthalenes and alkylated benzenes. The alkylated aromatic compound can be any hydrocarbyl molecule that contains at least 5% of its weight derived from an aromatic moiety such as a benzenoid moiety or naphthenoid moiety, or their derivatives. These alkylated aromatic compounds include alkyl benzenes, alkyl naphthalenes, alkyl diphenyl oxides, alkyl naphthols, alkyl diphenyl sulfides, aniline, alkyl substituted aniline, diphenylamines, alkylated bis-phenol A, alkylated thiodiphenol, and the like. The alkylated aromatic compounds can be mono-alkylated, dialkylated, polyalkylated, and the like. The aromatic can be mono- or poly-functionalized. The hydrocarbyl groups can range from $C_6$ up to $C_{60}$ with a range of $C_8$ to $C_{40}$ often being preferred. A mixture of hydrocarbyl groups is often preferred. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 2 cSt to 50 cSt are preferred, with viscosities of approximately 3.4 cSt to 20 cSt often being more preferred for the alkylated aromatic compound. Naphthalene or methyl naphthalene, for example, can be alkylated with olefins such as octene, decene, dodecene, tetradecene or higher, mixtures of similar olefins, and the like.

Illustrative alkylated naphthalenes useful in the present disclosure are described, for example, in U.S. Patent Publication No. 2008/0300157. Preferred alkylated naphthalenes include, for example, AN Synesstic™ 5 and AN Synesstic™ 12.

Examples of typical alkyl naphthalenes are mono-, di-, tri-, tetra-, or penta-$C_3$ alkyl naphthalene, $C_4$ alkyl naphthalene, $C_5$ alkylnaphthalene, $C_6$ alkyl naphthalene, $C_8$ alkyl naphthalene, $C_{10}$ alkyl naphthalene, $C_{1-2}$ alkyl naphthalene, $C_{1-4}$ alkyl naphthalene, $C_{1-6}$ alkyl naphthalene, $C_{1-8}$ alkyl naphthalene, etc., $C_{10}$-$C_{14}$ mixed alkyl naphthalene, $C_6$-$C_{18}$ mixed alkyl naphthalene, or the mono-, di-, tri-, tetra-, or penta $C_3$, $C_4$, $C_5$, $C_6$, $C_8$, $C_{10}$, $C_{12}$, $C_{14}$, $C_{16}$, $C_{18}$ or mixture thereof alkyl monomethyl, dimethyl, ethyl, diethyl, or methylethyl naphthalene, or mixtures thereof. The alkyl group can also be branched alkyl group with $C_{10}$-$C_{300}$, e.g., $C_{24}$-$C_{56}$ branched alkyl naphthalene, $C_{24}$-$C_{56}$ branched alkyl mono-, di-, tri-, tetra- or penta-$C_1$-$C_4$ naphthalene. These branched alkyl group substituted naphthalenes or branched alkyl group substituted mono-, di-, tri-, tetra- or penta $C_1$-$C_4$ naphthalene can also be used as mixtures with the previously recited materials. These branched alkyl group can be prepared from oligomerization of small olefins, such as $C_5$-$C_{24}$ alpha- or internal-olefins. When the branched alkyl group is very large (that is 8 to 300 carbons), usually only one or two of such alkyl groups are attached to the naphthalene core. The alkyl groups on the naphthalene ring can also be mixtures of the above alkyl groups. Sometimes mixed alkyl groups are advantageous because they provide more improvement of pour points and low temperature fluid properties. The fully hydrogenated fluid alkylnaphthalenes can also be used for blending with GTL base stock/base oil, but the alkyl naphthalenes are preferred.

Typically the alkyl naphthalenes are prepared by alkylation of naphthalene or short chain alkyl naphthalene, such as methyl or di-methyl naphthalene, with olefins, alcohols or alkylchlorides of 6 to 24 carbons over acidic catalyst inducing typical Friedel-Crafts catalysts. Typical Friedel-Crafts catalysts are $AlCl_3$, $BF_3$, HT, zeolites, amorphous alumniosilicates, acid clays, acidic metal oxides or metal salts, USY, etc.

Methods for the production of alkylnaphthalenes suitable for use in the present disclosure are described in U.S. Pat. Nos. 5,034,563, 5,516,954, and 6,436,882, as well as in references cited in those patents as well as taught elsewhere in the literature. Because alkylated naphthalene synthesis techniques are well known to those skilled in the art as well as being well documented in the literature such techniques will not be further addressed herein.

The naphthalene or mono- or di-substituted short chain alkyl naphthalenes can be derived from any conventional naphthalene-producing process from petroleum, petrochemical process or coal process or source stream. Naphthalene-containing feeds can be made from aromaticization of suitable streams available from the F-T process. For example, aromatization of olefins or paraffins can produce naphthalene or naphthalene-containing component. Many medium or light cycle oils from petroleum refining processes contain significant amounts of naphthalene, substituted naphthalenes or naphthalene derivatives. Indeed, substituted naphthalenes recovered from whatever source, if possessing up to three alkyl carbons can be used as raw material to produce alkylnaphthalene for this disclosure. Furthermore, alkylated naphtahlenes recovered from whatever source or processing can be used in the present method, provided they possess kinematic viscosities, VI, pour point, etc.

Suitable alkylated naphthalenes are available commercially from ExxonMobil under the tradename Synesstic AN or from King Industries under the tradename NA-Lube naphthalene-containing fluids.

Illustrative benzenes useful in this disclosure include, for example, those described in U.S. Patent Publication 2008/0300157. Alkylated benzenes having a viscosity at 100° C. of 1.5 to 600 cS, VI of 0 to 200 and pour point of 0° C. less, preferably −15° C. or less, more preferably −25° C. or less, still more preferably −35° C. or less, most preferably −60° C. or less are useful for this disclosure.

Illustrative monoalkylated benzenes include, for example, linear $C_{10}$-$C_{30}$ alkyl benzene or a $C_{10}$-$C_{300}$ branched alkyl benzene, preferably $C_{10}$-$C_{100}$ branched alkyl benzene, more preferably $C_{15}$-$C_{50}$ branched alkyl group. Illustrative multi-alkylated benzenes include, for example, those in which one or two of the alkyl groups can be small alkyl radical of $C_1$-$C_5$ alkyl group, preferably $C_1$-$C_2$ alkyl group. The other alkyl group or groups can be any combination of linear $C_{10}$-$C_{30}$ alkyl group, or branched $C_{10}$ and higher up to $C_3$-$C_{20}$ alkyl group, preferably $C_{15}$-$C_{50}$ branched alkyl group. These branched large alkyl radicals can be prepared from the oligomerization or polymerization of $C_3$ to $C_{20}$, internal or alpha-olefins or mixture of these olefins. The total number of carbons in the alkyl substituents ranged from $C_{10}$ to $C_{300}$. Preferred alkyl benzene fluids can be prepared according to U.S. Pat. Nos. 6,071,864 and 6,491,809.

Also included in this class and with very desirable lubricating characteristics are the aromatic compounds including the diphenyl compounds such as the alkylated diphenyl oxides, diphenyl sulfides and diphenyl methanes and the phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; and 5,371,248.

The aromatic compound is used in the process of this disclosure in an amount sufficient to react with the unsaturated hydrocarbon ester and form the saturated hydrocarbon esters. Typically the aromatic compound is used in an amount from 1% to 75%, preferably 2% to 50%, and more preferably 4% to 50%, depending on the application.

The process of this disclosure employs a catalyst. Illustrative catalysts include, for example, one or more Friedel-Crafts catalysts; protonic acid (Bronsted acid) catalysts, such as sulfuric acid, hydrochloric acid, and phosphoric acid; Amberlyst™ 15 (styrene-divinylbenzene polymer of Rohm & Haas, Co.); strongly acidic ion-exchange resins, such as Dowex™ 50W (The Dow Chemical Company); solid acid catalysts, such as zeolites (such as MCM22 and ZMS-48), acid clays, and amorphous solid acid catalysts (such as $WO_x/ZrO_2$ and silica-aluminate); ionic liquid catalysts; and any combination of the foregoing.

Other useful clay catalysts include commercially available clay catalysts, including the following: Filtrol™ and Retrol™ available from Engelhard; Fulcat™ 14, Fulmont™ 700C, Fulmont™ 237, and Fulcat™ 22B available from Laporte Industries; and Katalysator™ K10 available from Sud-Chemi. These clays may include acid-activated or acid-leached clays. The clay catalysts may contain some water as received or water may be removed prior to use by heating with a nitrogen sweep or with vacuum stripping. Acid-activated clays are preferred. However, Lewis Acids such as $AlCl_3$ or $BF_3$, and $BF_3$ complexes of diethyl ether, phenol, including mixtures thereof with clay could be used as well. A preferred catalyst is Engelhard F-24 acid-activated clay (formerly Filtrol's Retrol clays).

Preferred catalysts are Engelhard clay F-24 catalyst and acidic ionic liquids. Useful acidic ionic liquids have at least two components. The first component is an acidic compound. The second component is an ionic liquid.

The acidic compound is selected from among one or more aluminum halides, one or more alkyl aluminum halides, and any combination thereof. For example, the first component may be aluminum trichloride, aluminum bromide, iron (III) chloride, zinc chloride, and boron trifluoride.

The ionic liquid is a salt or mixture of salts which melts below room temperature and exhibits substantially no measurable vapor pressure below the point of thermal decomposition. Ionic liquids may be characterized by the general formula $Q^+A^-$, where is $Q^+$ is quaternary ammonium, quaternary phosphonium, quaternary sulfonium, and $A^-$ is a negatively charged ion such as $Cl^-$, $Br^-$, $OCl_4^-$, $NO_3^-$, $BF_4^-$, $BCl_4^-$, $PF_6^-$, $SbF_6^-$, $AlCl_4^-$, $CuCl_2^-$, and $FeCl_3^-$. Useful liquid salts include one or more hydrocarbyl-substituted ammonium halides, hydrocarbyl-substituted imidazolium halides, hydrocarbyl-substituted pyridinium halides, and hydrocarbyl-substituted phosphonium halides. Examples of liquid salts include 1-ethyl-3-methyl-imidazolium chloride, 1-butyl-3-methylimidazolium hexafluorophosphate, and trihexyl (tetradecyl)phosphonium chloride.

The mole ratio of the acid compound to the ionic liquid preferably ranges from 1:1 to 5:1 and more preferably from 1:1 to 2:1.

Following completion of the reaction, the organic layer containing the PAO product and the unreacted low molecular weight feed is separated from the ionic liquid phase. The acidic ionic liquid catalyst that remains after recovery of the organic phase may be recycled to the reaction, if desired.

Examples of useful second components for the acidic ionic liquid are as follows: 1-butyl-3-methylimidazolium hexafluorophosphate [$bmim^+$][$PF_6^-$]; trihexyl(tetradecyl) phosphonium chloride [$thtdPh^+$][$Cl^-$]; 1-ethyl-3-methylimidazolium methanesulfonate [$emim^+$][$CH_3SO_3^-$]; 1-ethyl-3-methylimidazolium thiocyanate [$emim^+$][$SCN^-$]; choline salicylate; and 1-ethyl-3-methylimidazolium tetrachloroaluminate [$emim^+$][$AlCl_4^-$].

Other ionic liquids that can be used as second components in the acidic ionic liquids include the following: 1-butyl-3-methylimidazolium hexafluorophosphate [bmim][$PF_6^-$]; 1-hexyl-3-methylimidazolium dioctylsulfosuccinate [hmim][$doss^-$]; 1-hexyl-3-methylimidazolium hexafluoroborate [hmim][$BF_4^-$]; 1-hexyl-3-methylimidazolium hexafluorophosphate [hmim][$PF_6^-$]; tetrabutyl ammonium dioctylsulfosuccinate [tbam][$doss^-$]; tetrabutyl phosphonium dioctylsulfosuccinate [tbPh][$doss^-$]; tributyl(tetradecyl)phosphonium dodecylbenzenesulfonate [tbtdPh][$dbs^-$]; tributyl(tetradecyl) phosphonium methanesulfonate [tbtdPh][$mes^-$]; trihexyl(tetradecyl)phosphonium bis(trifluoromethane) sulfonylimide [thtdPh][$Tf_2N^-$]; trihexyl(tetradecyl)phosphonium chloride [thtdPh][$Cl^-$]; trihexyl(tetradecyl)phosphonium decanoate [thtdPh][$deca^-$]; trihexyl(tetradecyl)phosphonium dodecylbenzenesulfonate [thtdPh][$dbs^-$]; and trihexyl(tetradecyl) phosphonium methanesulfonate [thtdPh][$mes^-$].

The catalyst is used in an amount sufficient to catalyze the alkylation reaction. Typically the catalyst is used in an amount from 0.1% to 1%, preferably 0.2% to 0.75%, and more preferably 0.25% to 0.5%.

The reagent stoichiometry can vary over a wide range and need only be amounts sufficient to produce the saturated hydrocarbon esters. The unsaturated hydrocarbon ester and aromatic compound can be used in a molar ratio ranging from 10:1 to 1:10, preferably from 5:1 to 1:5, and more preferably from 1.1:1 to 1:1.1.

The reaction can be carried out over a wide range of temperatures and is carried out at a temperature sufficient to effect reaction. The temperature will preferably be 25° C. to 195° C., more preferably 55° C. to 175° C., and most preferably 95° C. to 165° C. The reaction can be carried out at a single temperature or, sequentially, at different temperatures.

The reaction can likewise be carried out over a wide range of pressures and is carried out at a pressure sufficient to effect reaction. The reaction pressure will preferably be 250 psi (1.72 MPa) or less, and more preferably be 25 to 100 psi (0.17 to 0.69 MPa).

Inert gas, such as nitrogen, can be used to minimize oxidation of products during reaction and to allow operation at higher temperatures with oligomers of low boiling points. An atmosphere of nitrogen or other inert gas, in contrast to air, suppresses the formation of products that may deactivate the catalysts, particularly clay catalysts. Other benefits of nitrogen or other inert gas pressure include higher rates of reaction, shorter reaction times, and enhanced formation of alkylated product.

The molar ratio of unsaturated ester to aromatic ring is normally in the range of 10:1 to 1:10, preferably 1.0:1.0 to 4.0:1.0, more preferably in the range of 1.25:1.0 to 3.0:1.0, and most preferably in the range of 1.5:1.0 to 2.8:1.0. The mole ratio chosen for the reaction will affect the degree of naphthalene conversion to alkylate.

If desired, the reaction can be carried out in a neutral solvent such as mineral oil or an inert hydrocarbon solvent, but usually no solvent is necessary.

Reaction time is a very flexible reaction parameter and is dependent on the reaction temperature, mole ratio of reactants and catalysts, and pressure. The reaction will preferably be carried out over a period of 2 to 30 hours, more preferably over a period of 5 to 24 hours, and most preferably over a period of 6 to 16 hours.

Upon completion of the reaction, the desired alkylated naphthalene products can be isolated using conventional techniques, such as filtration, stripping under vacuum, or separation by elution with hexane using column chromatography. The diphenylamine-substituted product is preferably liquid at room temperature and atmospheric pressure.

The process of the present disclosure selectively converts the unsaturated hydrocarbon ester and aromatic compound to a saturated hydrocarbon ester. The selective conversion is preferably at least 75 mol %, e.g., 80-99 mol %, more preferably at least 90 mol %, especially at least 95 mol %.

Cobase Stock Components

Fatty acid ester based hybrid cobase stock useful in this disclosure include, for example, compositions containing comprises one or more compounds represented by the formula $$A(B)_x$$

wherein A is the residue of an aromatic compound, B is the residue of an unsaturated hydrocarbon ester, and x is a value of 1 or greater. The cobase stock has a viscosity ($Kv_{100}$) from 2 to 40 at 100° C., and a viscosity index (VI) from 100 to 200.

Illustrative fatty acid ester based hybrid cobase stock components useful in the present disclosure include, for example, the product of an unsaturated hydrocarbon ester, e.g., methyl oleate (bio-diesel), reacted with an aromatic compound, e.g., naphthalene, and the like.

Methods for the production of fatty acid ester based hybrid cobase stock components suitable for use in the present disclosure are described herein. For example, an unsaturated hydrocarbon ester, e.g., methyl oleate (bio-diesel), can be reacted with an aromatic compound, e.g., naphthalene. The reaction is carried out in the presence of a catalyst, e.g., 1-ethyl-3-methylimidazolium heptachloroaluminate. The reaction is carried out under reaction conditions sufficient to produce the fatty acid ester based hybrid cobase stock as more fully described hereinabove.

The fatty acid ester based hybrid cobase stock component is preferably present in an amount sufficient for providing solubility and dispersancy of polar additives and/or sludge in the lubricating oil. The fatty acid ester based hybrid cobase stock component is present in the lubricating oils of this disclosure in an amount from 1 to 50 wt %, preferably from 5 to 30 wt %, and more preferably from 10 to 20 wt %.

Other Additives

The formulated lubricating oil useful in the present disclosure may additionally contain one or more of the other commonly used lubricating oil performance additives including but not limited to dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Antioxidants

Typical antioxidant include phenolic antioxidants, aminic antioxidants and oil-soluble copper complexes.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R)_x—Ar—(OH)_y$$

where Ar is selected from the group consisting of:

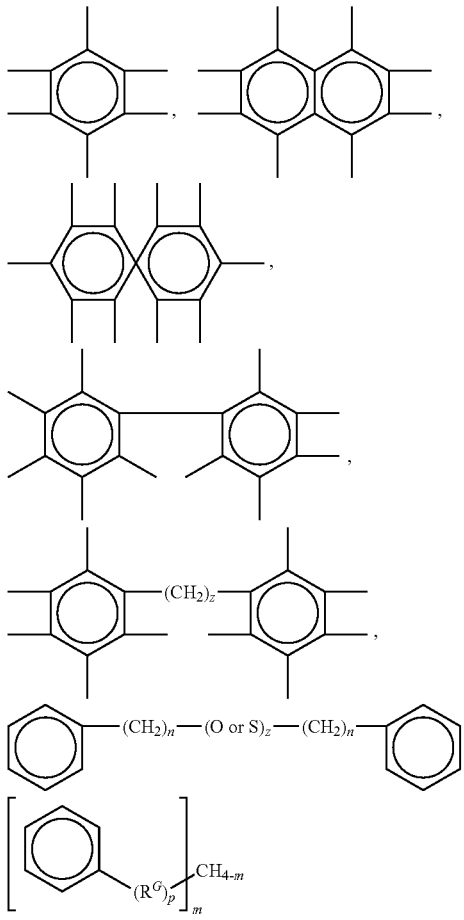

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic antioxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

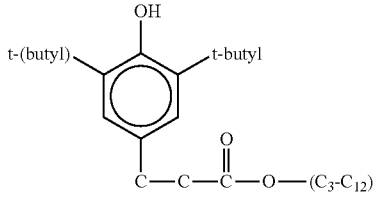

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

The phenolic antioxidant can be employed in an amount in the range of 0.1 to 3 wt %, preferably 0.25 to 2.5 wt %, more preferably 0.5 to 2 wt % on an active ingredient basis.

Aromatic amine antioxidants include phenyl-α-naphthyl amine which is described by the following molecular structure:

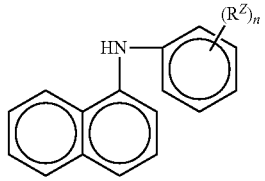

wherein $R^z$ is hydrogen or a $C_1$-$C_{14}$ linear or $C_3$-$C_{14}$ branched alkyl group, preferably $C_1$-$C_{10}$ linear or $C_3$-$C_{10}$ branched alkyl group, more preferably linear or branched $C_6$-$C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{19}$ is H, alkyl, aryl or $R^{11}S(O)_XR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of such other additional amine antioxidants which may be present include diphenylamines, phenothiazines, imidodibenzyls and diphenyl phenylene diamines Mixtures of two or more of such other additional aromatic amines may also be present. Polymeric amine antioxidants can also be used.

Another class of antioxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithiophosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Such antioxidants may be used individually or as mixtures of one or more types of antioxidants, the total amount employed being an amount of 0.50 to 5 wt %, preferably 0.75 to 3 wt % (on an as-received basis).

Detergents

In addition to the alkali or alkaline earth metal salicylate detergent which is an optional component in the present disclosure, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. As previously stated, however, it is preferred that such other detergent not be present in the formulation.

Such additional other detergents include by way of example and not limitation calcium phenates, calcium sulfonates, magnesium phenates, magnesium sulfonates and other related components (including borated detergents).

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines Molar ratios can vary depending on the amine or polyamine. For example, the molar ratio of alkenyl succinic anhydride to TEPA can vary from 1:1 to 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines Process aids and catalysts, such as oleic acid and sulfonic acids, can also be part of the reaction mixture. Molecular weights of the alkylphenols range from 800 to 2,500 or more.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or more or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, more preferably 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of 0.0 to 0.5 wt %, preferably 0 to 0.3 wt %, more preferably 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of 0.01 to 3 wt %, preferably 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to 0.5 wt %, more preferably 0.001 to 0.2 wt %, still more preferably 0.0001 to 0.15 wt % (on an as-received basis) based on the total weight of the lubricating oil composition.

Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % on an as-received basis.

In addition to the ZDDP anti-wear additives which are essential components of the present disclosure, other anti-wear additives can be present, including zinc dithiocarbamates, molybdenum dialkyldithiophosphates, molybdenum dithiocarbamates, other organo molybdenum-nitrogen complexes, sulfurized olefins, etc.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that disclosure; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri-nuclear molybdenum-sulfur compounds described in EP 1 040 115 and WO 99/31113 and the molybdenum complexes described in U.S. Pat. No. 4,978,464.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

EXAMPLES

Alkylation of Naphthalene with Methyl Oleate (Bio-Diesel) Using 1-Ethyl-3-Methyl Imidazolium Heptachloroaluminate 5.0 grams of (FW 296.5, 0.01686 mol) methyl oleate, 2.16 grams of (FW 128.06, 0.01686 mol) naphthalene and 7.0 grams of decane were charged in a 25 milliliter thick glass reactor under $N_2$ atmosphere. 4.2 grams of (FW 413, 0.6% equivalent) freshly prepared 1-ethyl-3-methylimidazolium heptachloroaluminate was added very slowly at room temperature. After addition, the reaction mixture was stirred for 24 hours at 120° C. The reaction was stopped by adding 20 milliliters of water and 50 milliliters of toluene. The product was washed with (1×25 milliliters) saturated $NaHCO_3$ and brine solution (1×25 milliliters) until, the aqueous layer pH was 7. The product was dried and filtered. The low boiling (toluene) component was removed by rotavapory and the high boiling component (decane, methyl oleate) by air bath oven at 180° C. under vacuum for 1 hour. The final product was determined by IR and NMR. Yields: 6.3 g (88%). IR: ($cm^{-1}$) 2925, 2854, 1743, 1598, 1509, 1464, 1436, 1365, 1196, 1171, 1018, 818, 796, 779, 746, 723. $^1H$ NMR (400 MHz; CDCl3): δ (ppm)=0.88 (t, 3H, —CH3), 1.26 (m, 28H, —CH2-), 1.61-196 (m, 5H, —CH2-CH—CH2-), 2.28 (t, 2H, —C(O)—CH2-), 3.66 (s, 3H, —OCH3), 7.30-7.46 (m, 4H), 7.54-7.83 (m, 3H). 8.12 (d, 1H).

The lube properties of the product were evaluated and the data is shown below along with AN Synesstic™ 5 and AN Synesstic™ 12. The viscosity of the product at 100° C. was 7.6 cSt, at 40° C. was 45.3 cSt with viscosity index (VI) of 134. The viscometric data of the product suggests that the fluid has good lubricant properties. The data was compared with AN Synesstic™ 5 and AN Synesstic™ 12 and methyl oleate. See Table 1 below.

TABLE 1

Lube Properties of Base Stocks

| Base Stock | $Kv_{100}$ cSt | $Kv_{40}$ cSt | Viscosity Index (VI) |
|---|---|---|---|
| Example 1 (26232-19) | 7.6 | 45.3 | 134 |
| Alkylated Naphthalene (Synestic12) | 4.7 | 29 | 74 |
| Alkylated Napthalene (Synestic 5) | 12.4 | 109 | 105 |
| Methyl Oleate | 1.75 | 4.54 | — |

The data shows the preparation of a hybrid Group V base stock with both naphthalene and ester functionality.

The viscosity index of the fluid is better than alkylated naphthalene base stocks. The VI is an empirical, unit-less measure of a material's change in viscosity to change in temperature. The viscosity-temperature relationship of a lubricating oil is one of the critical criteria which must be considered when selecting a lubricant for a particular application. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements. In another aspect, as the oil operating temperature decreases, the viscosity of a high VI oil will not increase as much as the viscosity of a low VI oil. This is advantageous because the excessive high viscosity of the low VI oil will decrease the efficiency of the operating machine. Thus high VI (HVI) oil has performance advantages in both high and low temperature operation. The VI was determined according to ASTM method D 2270-93 [1998]. The VI is related to kinematic viscosities measured at 40° C. and 100° C. using ASTM Method D 445-01.

PCT and EP Clauses:

1. A process for producing a composition comprising one or more saturated hydrocarbon esters, said process comprising reacting an unsaturated hydrocarbon ester with an aromatic compound in the presence of a catalyst and under reaction conditions sufficient to produce said composition.

2. The process of clause 1 wherein the composition comprises a Group V base oil stock having a viscosity ($Kv_{100}$) from 2 to 40 at 100° C., and a viscosity index (VI) from 100 to 200.

3. The process of clauses 1 and 2 wherein (i) the unsaturated hydrocarbon ester is derived from a renewable feedstream selected from canola oil, corn oil, soybean oil, rapeseed oil, algae oil, peanut oil, mustard oil, sunflower oil, tung oil, tall oil, perilla oil, grapeseed oil, linseed oil, safflower oil, pumpkin oil, palm oil, *Jatropha* oil, high-oleic soybean oil, high-oleic safflower oil, high-oleic sunflower oil, mixtures of animal and vegetable fats and oils, beef tallow, castor bean oil, dehydrated castor bean oil, cucumber oil, poppyseed oil, flaxseed oil, lesquerella oil, walnut oil, cottonseed oil, meadowfoam, tuna oil, sesame oils, waste oils/greases, and mixtures thereof, and (ii) the aromatic compound is selected from benzenes, alkyl benzenes, naphthalenes, alkyl naphthalenes, diphenyl oxides, alkyl diphenyl oxides, aniline, alkyl substituted aniline, diphenylamines, naphthols, alkyl naphthols, diphenyl sulfides, alkyl diphenyl sulfides, bis-phenol A, alkylated bis-phenol A, thiodiphenol and alkylated thiodiphenol.

4. The process of clauses 1-3 wherein the aromatic compound is an alkyl naphthalene selected from mono-, di-, tri-, tetra-, or penta-$C_3$ alkyl naphthalene, $C_4$ alkyl naphthalene, $C_5$ alkylnaphthalene, $C_6$ alkyl naphthalene, $C_8$ alkyl naphthalene, $C_{10}$ alkyl naphthalene, $C_{1-2}$ alkyl naphthalene, $C_{1-4}$ alkyl naphthalene, $C_{1-6}$ alkyl naphthalene, $C_{1-8}$ alkyl naphthalene, $C_{10}$-$C_{14}$ mixed alkyl naphthalene, $C_6$-$C_{18}$ mixed alkyl naphthalene, or mono-, di-, tri-, tetra-, or penta-$C_3$, $C_4$, $C_5$, $C_6$, $C_8$, $C_{10}$, $C_{12}$, $C_{14}$, $C_{16}$, $C_{18}$ or mixture thereof alkyl monomethyl, dimethyl, ethyl, diethyl, or methylethyl naphthalene, or mixtures thereof.

5. The process of clauses 1-4 wherein the catalyst is selected from a Friedel-Crafts catalyst, a protonic acid catalyst, an ionic liquid catalyst, and combinations thereof.

6. The process of clause 5 wherein the wherein the ionic liquid catalyst has (i) an ionic liquid component selected from the group consisting of 1-butyl-3-methylimidazolium hexafluorophosphate [$bmim^+$][$PF_6^-$], trihexyl(tetradecyl) phosphonium chloride [$thtdPh^+$][$Cl^-$], 1-ethyl-3-methylimidazolium methanesulfonate [$emim^+$][$CH_3SO_3^-$], 1-ethyl-3-methylimidazolium thiocyanate [$emim^+$][$SCN^-$], choline salicylate, 1-ethyl-3-methylimidazolium tetrachloroaluminate [$emim^+$][$AlCl^{4-}$], 1-butyl-3-methylimidazolium hexafluorophosphate [bmim][$PF_6^-$], 1-hexyl-3-methylimidazolium dioctylsulfosuccinate [hmim][$doss^-$], 1-hexyl-3-methylimidazolium hexafluoroborate [hmim][$BF_4^-$], 1-hexyl-3-methylimidazolium hexafluorophosphate [hmim][$PF_6^-$], tetrabutyl ammonium dioctylsulfosuccinate [tbam][$doss^-$], tetrabutyl phosphonium dioctylsulfosuccinate [tbPh][$doss^-$], tributyl(tetradecyl)phosphonium dodecylbenzenesulfonate [tbtdPh][$dbs^-$]; tributyl(tetradecyl)phosphonium methanesulfonate [tbtdPh][$mes^-$], trihexyl(tetradecyl)phosphonium bis(trifluoromethane) sulfonylimide [thtdPh]

[$Tf_2N^-$], trihexyl(tetradecyl)phosphonium chloride [thtdPh][$Cl^-$], trihexyl(tetradecyl)phosphonium decanoate [thtdPh][deca$^-$], trihexyl(tetradecyl)phosphonium dodecylbenzenesulfonate [thtdPh][dbs$^-$]; and trihexyl(tetradecyl)phosphonium methanesulfonate [thtdPh][mes$^-$] an acid component selected from one or more aluminum halides, one or more alkyl aluminum halides, and combinations thereof; and (ii) an acid component selected from the group consisting of one or more aluminum halides, one or more alkyl aluminum halides, and combinations thereof.

7. The process of clauses 1-6 wherein the unsaturated hydrocarbon ester and aromatic compound are reacted in a molar ratio of from 10:1 to 1:10.

8. A composition produced by the process of clauses 1-7.

9. A composition comprising one or more compounds represented by the formula $$A(B)_x$$

wherein A is the residue of an aromatic compound, B is the residue of an unsaturated hydrocarbon ester, and x is a value of 1 or greater; wherein the composition has a viscosity ($Kv_{100}$) from 2 to 40 at 100° C., and a viscosity index (VI) from 100 to 200.

10. The composition of clause 9 wherein (i) the residue of an unsaturated hydrocarbon ester is derived from a renewable feedstream selected from canola oil, corn oil, soybean oil, rapeseed oil, algae oil, peanut oil, mustard oil, sunflower oil, tung oil, tall oil, perilla oil, grapeseed oil, linseed oil, safflower oil, pumpkin oil, palm oil, *Jatropha* oil, high-oleic soybean oil, high-oleic safflower oil, high-oleic sunflower oil, mixtures of animal and vegetable fats and oils, beef tallow, castor bean oil, dehydrated castor bean oil, cucumber oil, poppyseed oil, flaxseed oil, lesquerella oil, walnut oil, cottonseed oil, meadowfoam, tuna oil, sesame oils, waste oils/greases, and mixtures thereof, and (ii) the residue of an aromatic compound is derived from benzenes, alkyl benzenes, naphthalenes, alkyl naphthalenes, diphenyl oxides, aniline, alkyl substituted aniline, diphenylamines, alkyl diphenyl oxides, naphthols, alkyl naphthols, diphenyl sulfides, alkyl diphenyl sulfides, bis-phenol A, alkylated bis-phenol A, thiodiphenol and alkylated thiodiphenol.

11. A lubricating engine oil comprising one or more compounds represented by the formula $$A(B)_x$$

wherein A is the residue of an aromatic compound, B is the residue of an unsaturated hydrocarbon ester, and x is a value of 1 or greater; wherein the composition has a viscosity ($Kv_{100}$) from 2 to 40 at 100° C., and a viscosity index (VI) from 100 to 200.

12. The lubricating engine oil of clause 11 which comprises a Group V base oil stock.

13. The lubricating engine oil of clauses 11 and 12 wherein (i) the residue of an unsaturated hydrocarbon ester is derived from a renewable feedstream selected from canola oil, corn oil, soybean oil, rapeseed oil, algae oil, peanut oil, mustard oil, sunflower oil, tung oil, tall oil, perilla oil, grapeseed oil, linseed oil, safflower oil, pumpkin oil, palm oil, *Jatropha* oil, high-oleic soybean oil, high-oleic safflower oil, high-oleic sunflower oil, mixtures of animal and vegetable fats and oils, beef tallow, castor bean oil, dehydrated castor bean oil, cucumber oil, poppyseed oil, flaxseed oil, lesquerella oil, walnut oil, cottonseed oil, meadowfoam, tuna oil, sesame oils, waste oils/greases, and mixtures thereof, (ii) the residue of an aromatic compound is derived from benzenes, alkyl benzenes, naphthalenes, alkyl naphthalenes, diphenyl oxides, aniline, alkyl substituted aniline, diphenylamines, alkyl diphenyl oxides, naphthols, alkyl naphthols, diphenyl sulfides, alkyl diphenyl sulfides, bis-phenol A, alkylated bis-phenol A, thiodiphenol and alkylated thiodiphenol.

14. The lubricating engine oil of clauses 11-13 further comprising one or more of a viscosity improver, antioxidant, detergent, dispersant, pour point depressant, corrosion inhibitor, metal deactivator, seal compatibility additive, anti-foam agent, inhibitor, and anti-rust additive.

15. A method for improving one or more of solubility and dispersancy of polar additives in a lubricating oil by using as the lubricating oil a formulated oil; wherein the formulated oil comprises a lubricating oil base stock comprising one or more compounds represented by the formula $$A(B)_x$$

wherein A is the residue of an aromatic compound, B is the residue of an unsaturated hydrocarbon ester, and x is a value of 1 or greater; and wherein the formulated oil has a viscosity ($Kv_{100}$) from 2 to 40 at 100° C., and a viscosity index (VI) from 100 to 200.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A lubricating engine oil comprising a base stock selected from the group consisting of a Group I, a Group II, Group III, Group IV and combinations thereof and one or more Group V base oil stock compounds represented by the formula $$A(B)_x$$

wherein A is the residue of an aromatic compound, B is the residue of an unsaturated fatty acid methyl ester, and x is a value of 1 or greater; wherein the composition has a viscosity ($Kv_{100}$) from 2 to 40 at 100° C., and a viscosity index (VI) from 100 to 200.

2. The lubricating engine oil of claim 1 wherein the residue of an unsaturated is derived from a renewable feedstream selected from canola oil, corn oil, soybean oil, rapeseed oil, algae oil, peanut oil, mustard oil, sunflower oil, tung oil, tall oil, perilla oil, grapeseed oil, linseed oil, safflower oil, pumpkin oil, palm oil, *Jatropha* oil, high-oleic soybean oil, high-oleic safflower oil, high-oleic sunflower oil, mixtures of animal and vegetable fats and oils, beef tallow, castor bean oil, dehydrated castor bean oil, cucumber oil, poppyseed oil, flaxseed oil, lesquerella oil, walnut oil, cottonseed oil, meadowfoam, tuna oil, sesame oils, waste oils/greases, and mixtures thereof.

3. The lubricating engine oil of claim 1 wherein the residue of an aromatic compound is derived from benzenes, alkyl benzenes, naphthalenes, alkyl naphthalenes, diphenyl oxides, aniline, alkyl substituted aniline, diphenylamines, alkyl diphenyl oxides, naphthols, alkyl naphthols, diphenyl sulfides, alkyl diphenyl sulfides, bis-phenol A, alkylated bisphenol A, thiodiphenol and alkylated thiodiphenol.

4. The lubricating engine oil of claim 1 further comprising one or more of a viscosity improver, antioxidant, detergent, dispersant, pour point depressant, corrosion inhibitor, metal deactivator, seal compatibility additive, anti-foam agent, inhibitor, and anti-rust additive.

5. A method for improving one or more of solubility and dispersancy of polar additives in a lubricating oil by using as the lubricating oil a formulated oil; wherein the formulated oil comprises a Group V lubricating oil base stock comprising one or more compounds represented by the formula $$A(B)_x$$

wherein A is the residue of an aromatic compound, B is the residue of an unsaturated fatty acid methyl ester; and x is a value of 1 or greater; and wherein the formulated oil has a viscosity ($Kv_{100}$) from 2 to 40 at 100° C., and a viscosity index (VI) from 100 to 200.

* * * * *